US006012865A

United States Patent [19]

Scott

[11] Patent Number: 6,012,865

[45] Date of Patent: Jan. 11, 2000

[54] REMOTE CONTROL MULTI POSITION PAINT ROLLER FRAME

[76] Inventor: Julius Rosman Scott, 4625 S. Mead, St. Seattle, Wash. 98118

[21] Appl. No.: 08/843,276

[22] Filed: Apr. 14, 1997

[51] Int. Cl.[7] ..... B05C 17/03; B05C 17/02

[52] U.S. Cl. ..... 401/197; 15/144.1; 15/230.11; 492/13; 492/19

[58] Field of Search ..... 15/144.1, 230.11; 401/197; 492/13, 19

[56] References Cited

U.S. PATENT DOCUMENTS

| | | | |
|---|---|---|---|
| 2,761,167 | 9/1956 | Bridgford | 401/197 X |
| 2,799,884 | 7/1957 | Bedford | 15/230.11 |
| 3,273,192 | 9/1966 | Mazzella | 15/230.11 |
| 4,089,082 | 5/1978 | McGrew | 15/230.11 |
| 4,196,491 | 4/1980 | Baril | 15/230.11 |
| 4,528,714 | 7/1985 | Beck | 15/230.11 |
| 5,715,562 | 2/1998 | Lowrey et al. | 15/230.11 |

FOREIGN PATENT DOCUMENTS

| | | | |
|---|---|---|---|
| 1190520 | 7/1985 | Canada | 15/230.11 |
| 3302933 | 8/1983 | Germany | 401/197 |
| 94/00245 | 1/1994 | WIPO | 15/230.11 |

*Primary Examiner*—Mark Spisich

[57] ABSTRACT

The invention is a continuous frame multi-position paint roller device which can be remotely controlled and is characterized by a frame with an axle rod on which the paint roller axis is established and a roller support rail that leads to a pivot point canted such that the mounted handle is co-planer with the axis of the paint roller and moveable relative to each other which along with the remote locking assembly allows device to be used in any position and with remote ability to change angles right or left of center quickly and return to zero for optimal charging of paint roller in the roller paint tray or five gallon paint bucket screen and this device features an inexpensive washer bushing which may be replaced when worn.

3 Claims, 5 Drawing Sheets

REMOTE CONTROL MULTI POSITION PAINT ROLLER FRAME

FIELD OF THE INVENTION

This invention generally relates to paint roller frames for the application of paint. More specifically, to variable angle paint roller frames that can be readily adjusted to facilitate horizontal, vertical or other directional painting motions.

PRIOR ART

Painting in the last twenty years switched primarily from brush to roller application. This change has happened for a number of reasons, Firstly, rollers are easier to use. Secondly, rollers don't leave brush strokes. Thirdly, rollers are faster on flat surfaces. The typical paint roller which consists of a fixed positioned roller frame with roller cover and optionally an extension pole for greater reach. These type paint roller have their disadvantages. Firstly, one has to bend to paint a horizontal base board. Secondly, the difficulty of painting high, narrow spaces, such as hallways and closets. Thirdly, the difficulty of painting flooring and decks. Lastly, the need for the multi-positional roller has been clearly demonstrated by the number of such rollers developed. However, typically, these rollers have not found their way into wide-spread use for a number of reasons.

1. The difficulty of charging the roller with paint using a standard size paint roller tray when the roller is positioned at 45° degrees or greater, as evidenced with U.S. Pat. 4,528,714 and U.S. Pat. No. 4,089,082.

2. The need to manually release the butterfly nut and physically move either of these rollers in a position perpendicular to their handles to optimally charge rollers with paint,and then back to the desired painting position.

3. An earlier paint roller, U.S. Pat. 3,044,094 suffered more difficulty charging the roller with a standard roller tray, when said roller was in a parallel position with respect to its handle. This paint roller was also heavier than the standard roller thereby more quickly fatiguing the user.

4. Other obstacles in developing the multi-positional roller, included weak joints and pivots that became loose or broken with use. Often, now tools are more difficult to use than their advantage suggests. This seems to be the case history of the adjustable (multi-positional) paint roller frames to this point. It is an object of the present (invention) to provide a easily manufactured tool of light weight durable construction that is easy to use, simple to adjust; and gives a speed advantage to its user.

SUMMARY OF THE INVENTION

The principal object of the present invention is to provide a device for use in painting multiple angles. A second object is a device that can be positioned remotely, It is yet another object to provide a frame of simple construction with the pivot point and roller axis on a single frame. The other objectives include an invention to provide a easily manufactured tool of light weigh durable construction that is easy to use, simple to adjust; and gives a speed advantage to its user.

Detail Description of Preferred Embodiment

Figure 1:
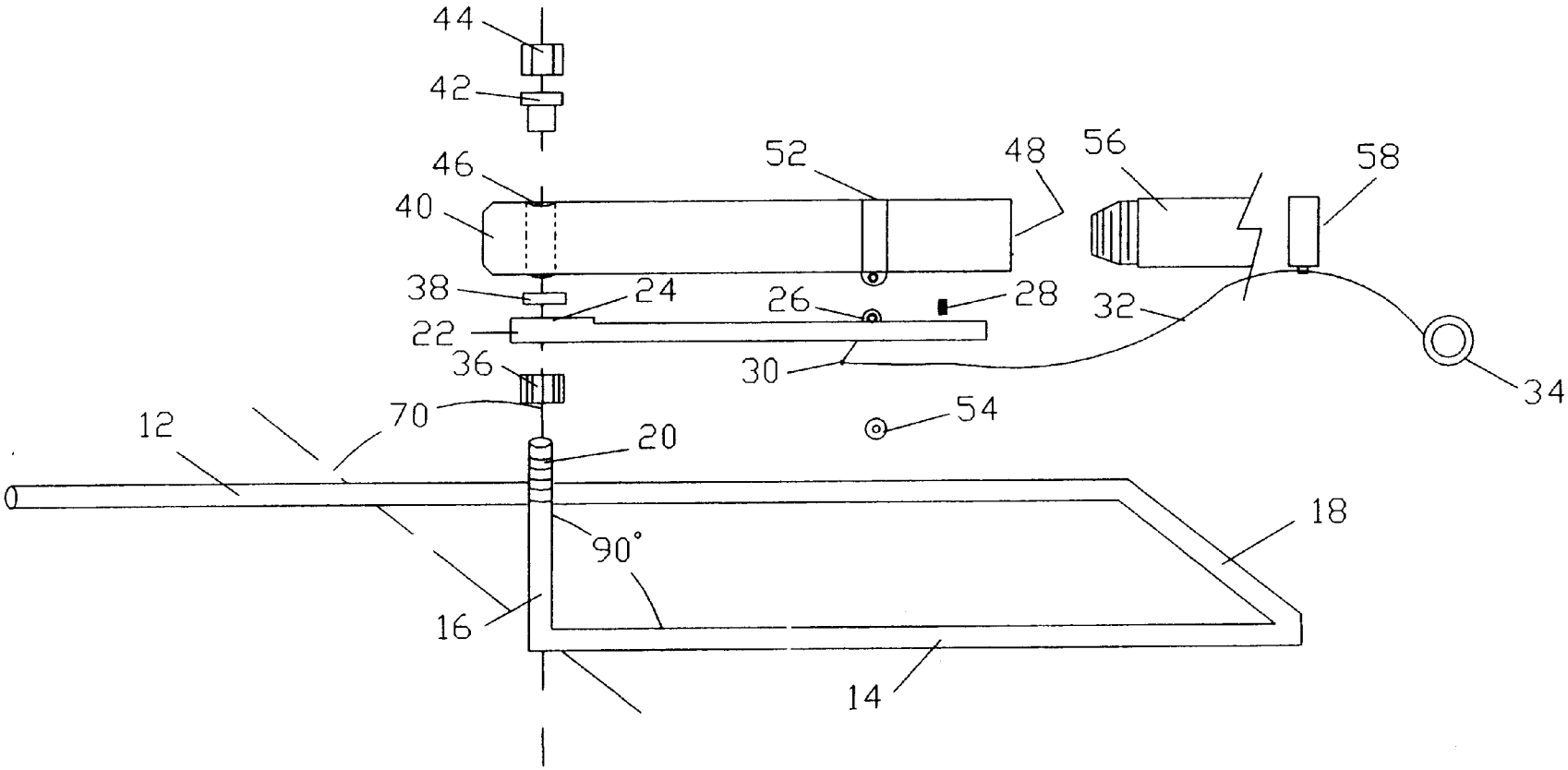
FIG. 1 is an exploded view of the preferred embodiment.
Figure 2:
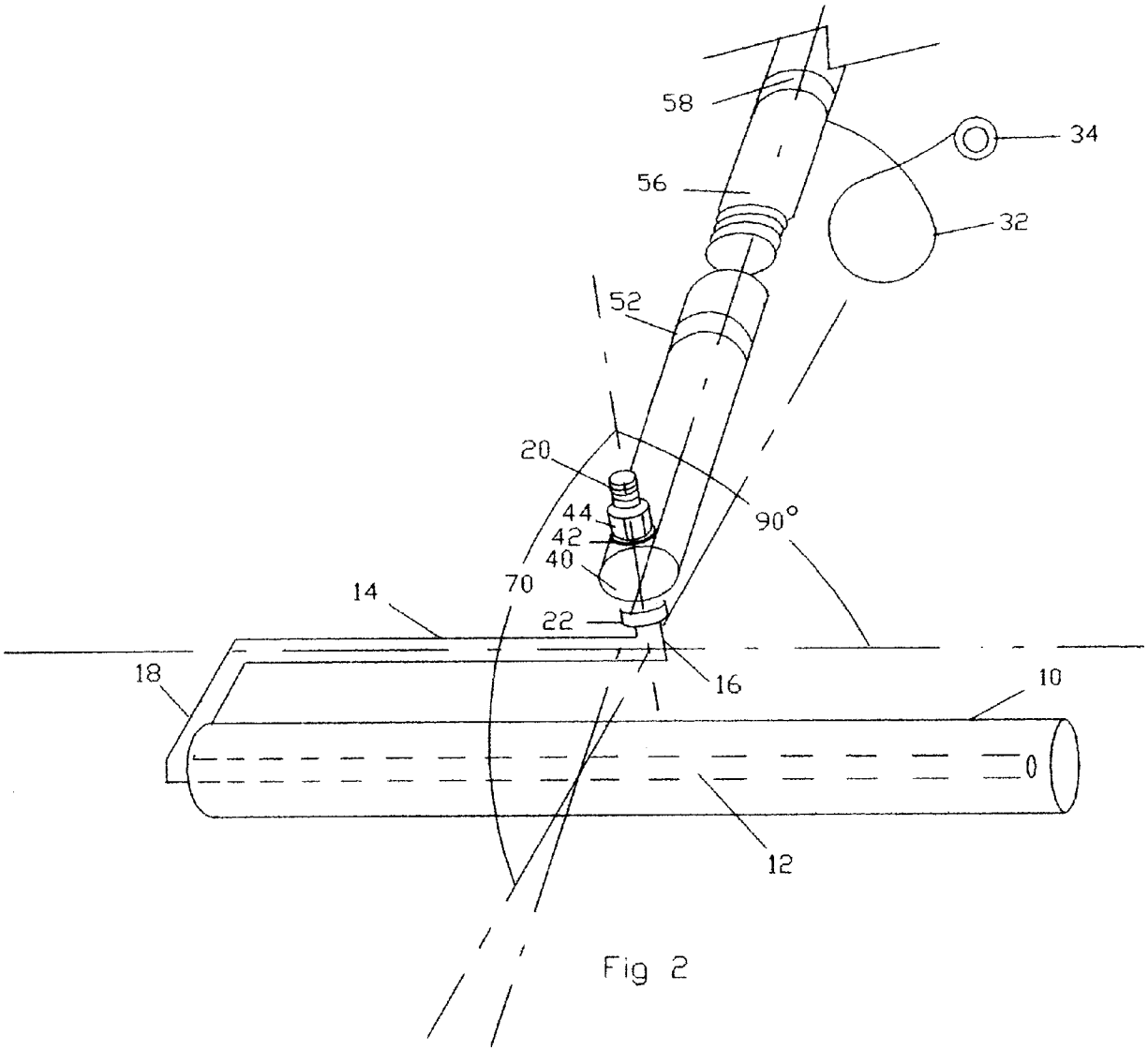
FIG. 2 is a perspective view detailing needed angles to achieve optimal performance.
Figure 3:
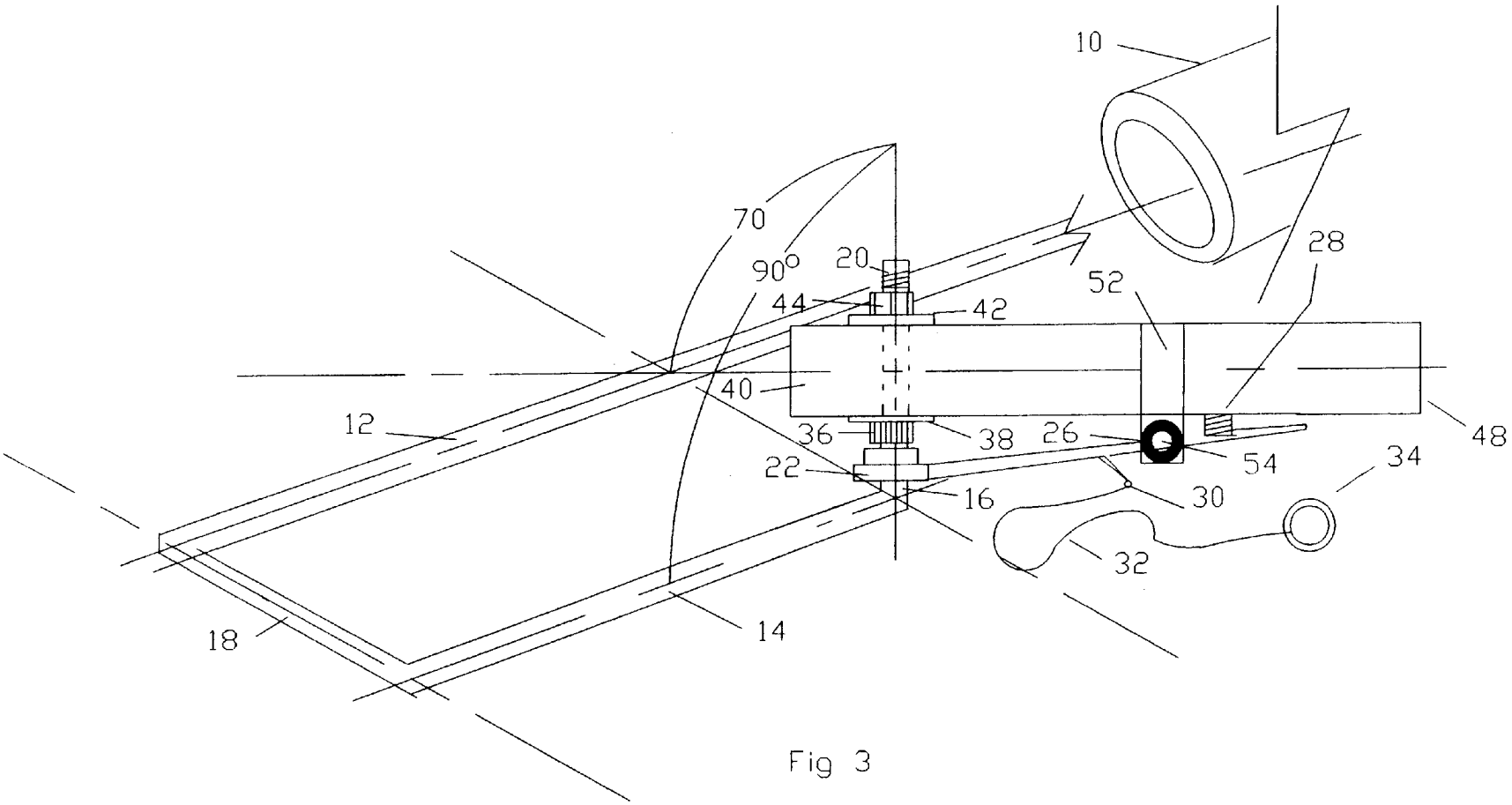
FIG. 3 is a side view showing the locking assembly.
Figure 4:
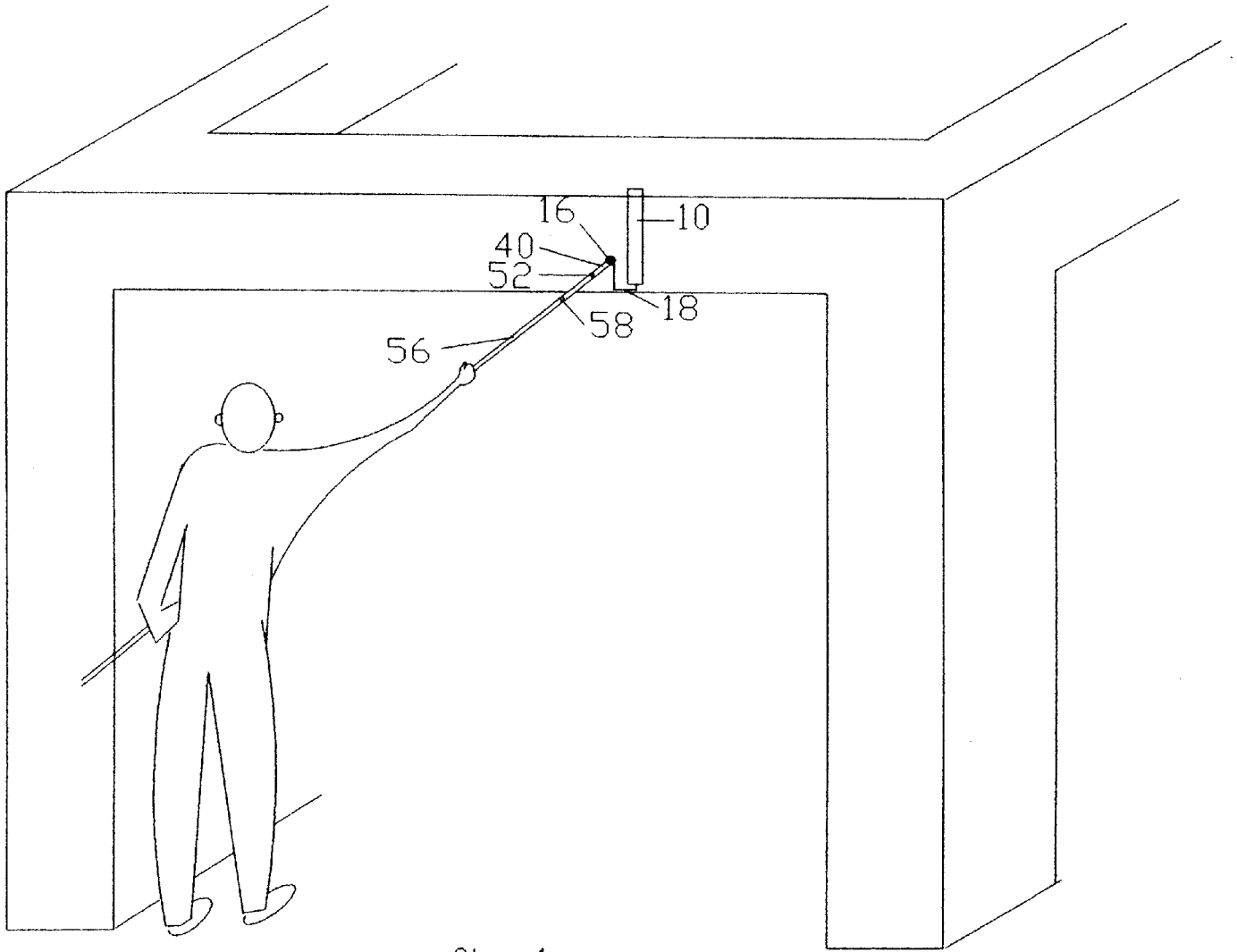
FIG. 4 is a view of the invention in use.

Refer to FIG. 1,2, and 3.

The preferred embodiment uses wire that is bent into three ninety-degree bends with threads cut in at one end of said wire. Number one bend occurs inside of the unthreaded end at a distance sufficient to establish the axle rod 12. Said bend also defines the end of said rod and the beginning of the crosspiece 18. The number two bend occurs both at the end of said crosspiece and defines the beginning of the roller support rail 14. Said rail is lying substantially parallel and on the same plane as said rod. Number three bend is bent orthogonal to the plane, center, of said axle, and define both the end of said rail and the beginning of the pivot point 16. Said point leads to, and ends with, the threaded pivot shaft 20. Said point and shaft are rotated laterally towards said rod, and, on the longitudinal axis of said rail, to an acute angle 70 relative to the plane. Said angle remains perpendicular to the longitudinal axis of said rail. (See FIG. 2) The roller cage/cover 10 is mounted on said rod. The handle 40 comprises an elongated shank. Said handle has the pivot hole 46 bored, centered, near one end, and perpendicular to the longitudinal axis of said handle. On the opposite end, of said handle, the extension pole hole 48 is bored longitudinal and threaded such to receive the matted end of the extension pole 56. The locking device comprising the pivot hole band 52; the string support band 58; the threaded gear 36; the finger pull ring 34; the string lever 30; the coil spring 28; the pivot pin 54; the elongated bar 22. Said bar is further defined by having at one end, the lock hole 24 with evenly spaced indentations mated to the outside contours of said gear. Near the center of said bar the fulcrum kick 26, with room in said kick for the pivot pin 54. On opposite side of said kick, the string lever 30 with a means to attach the string 32.

The Assemblage of the Preferred Embodiment (Refer to FIG. 1 and 3)

The continuous wire frame comprising items 12, 18, 14, 16, 70, and 20 is the form in which the other items are assembled onto. Referring to FIG. 3, the roller cage/cover 10 is mounted onto the axle rod 12. Referring to FIG. 1, the lock hole 24, of the elongated bar is placed onto the threaded pivot shaft 20, and allowed to rest on the pivot point 16. The threaded gear 36 is threaded onto said shaft. Said gear is oriented so that when it is engaged with said hole of said bar, said bar is perpendicular to said rod. The washer 38 is placed onto said shaft. The handle 40 is placed onto said shaft by means of the pivot hole 46. The washer bushing 42 is placed into said hole and onto said shaft. The lock nut 44, is tightened onto said shaft enough to prevent free movement yet allow movement when sufficient pressure is applied to said handle and said rod in a motion relative and against each other. The pivot band 52 is placed around said handle. The said bar is secured to said handle by passing the pivot pin 54 into one side of said band, through the hole in the fulcrum kick 26 and out the other side of said band. The coil spring 28 is secured in the compressed space between said handle and said bar when joined in the aforementioned fashion. The string 32 is attached at one end, to the lever 30, and the opposite end of said string is attached to the finger pull ring 34. The extension pole 56 is threaded into the extension pole hole 48. The string support band 58 is mounted on said pole. Said ring end of said string is mounted on said band. When said handle is a normal configuration the longitudinal center axis of said handle intersects the center axis of, and is perpendicular to the center axis of said rod. Said rail is set at a distance sufficient to both maximize and transfer the action of the wrist to said point and allow the roller cage and a thick nap roller cover. When said handle is rotated on said point, the longitudinal center axis of said handle intersects the center axis of said rod, throughout the traverse of said handle along said rod. Although some of the preferred dimension is given they are representational and are not use to limit the scope of this invention.

Directions for using the Preferred Embodiment

Assemble the preferred embodiment. Make sure that the extension pole 56 is turned snuggly into the extension pole hole 48. A little practice is needed to get the best results. To this end, using the preferred embodiment, simulate the normal vertical movement of a paint roller on a dry wall without using paint. This movement will look, feel, and sound like any other paint roller. Holding the roller cage-cover 10 flat on the wall, pull the finger pull ring 34 and pivot the handle 40 towards the open end of the roller frame. Release said ring and allow said handle to lock. Repeat the same vertical patterns on the wall. It will take a different skill level to keep the roller flat on the wall. (Thus the need for practice). Experiment with different directions and angles on the wall. Pull said ring and return said handle to the neutral position, (perpendicular to the axle rod 12). Release said ring and allow said handle to lock. With said handle in said neutral position, using a low ceiling, corner, and floor, count the number of right angle flat surfaces you can engage efficiently without moving your feet. Next, pull said ring and pivot said handle towards the open end of said frame. Perform the same experiment and note the difference. With a little practice, you apply paint and other coatings with ease and speed.

Assemblage FIG. (5*a*)

Beginning with the hollow frame 62. Tighten the nut 94 onto the hollow threaded pivot point 92 end of said frame. Place the washer 74 onto said point. Mount the handle 88 onto said point by means of the handle pivot hole 84. Place the washer bushing 96 into said pivot hole onto said point. Tighten the butterfly nut 86 onto said point. Tighten said butterfly nut enough to prevent free movement, of said handle and said frame relative to each other, yet, allow movement when a sufficient pressure is applied to one against the other. Mount the perforated roller cover 64 onto the open end of said frame, and, over the paint exit ports 68. Secure said cover by engaging the retainer 60 with the receiver end 66. Connect the supply tube connector 78 to the hollow threaded pivot point 92. Said tube is connected to the compressor pump 80. Said pump is mounted onto the paint supply 82.

Directions for using FIG. (5*a*)

Figure 5A:
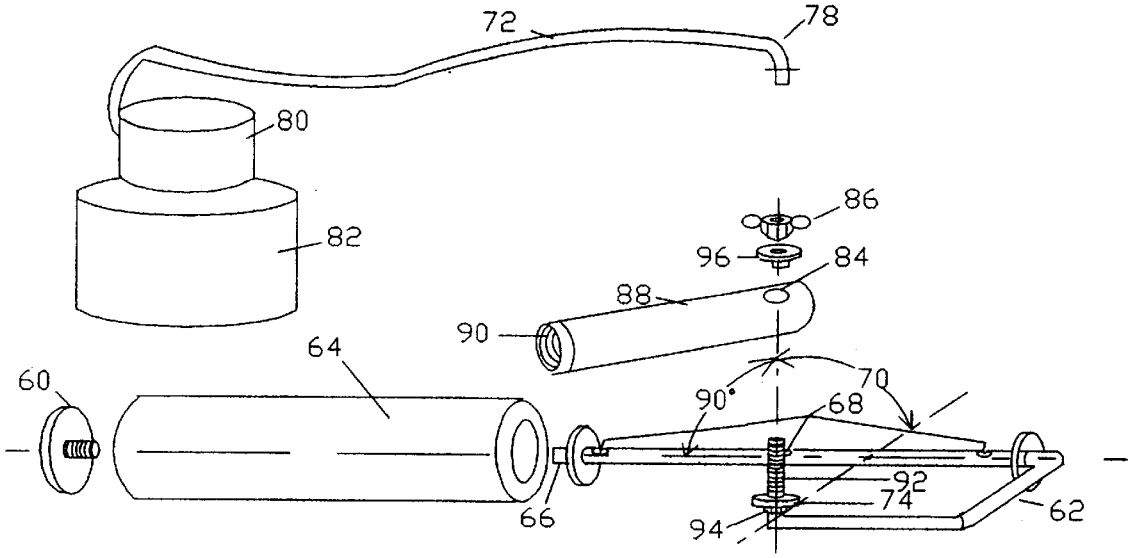
FIG. 5*a* is a continuous hollow frame with a means to supply paint to the roller.

Fill the paint supply 82. Insure that paint supply connections are secure. Pick up by the handle 88. Turn on the compressor pump 80. Allow paint to flow to the perforated roller cover 64 by way of the paint exit ports 68, in the hollow frame 62. Begin to roll area to be treated. To change, the angle of said handle, relative to said frame and said cover, hold said cover flat on surface to be treated and rotate said handle on the hollow threaded pivot point 92, The angle can also be changed by, holding the said frame in one hand and moving said handle relative to said frame. For added reach a standard extension pole, (not shown in FIG. 5*a*), may be threaded into the threaded receiver hole 90.

Assemblage of FIG. (5*b*)

The one piece wire frame 104 has, at one end, the axle rod 102, and at the other end, the looped pivot point 106 The roller cage/cover 116 is mounted onto said rod. The yoke handle 98 is mounted onto said point. The bolt 100 secures said handle to said point in following manner. One of the washers 112 is placed onto the shank portion of said bolt, said shank is passed though one of the handle pivot holes 108, through said point and through the second of said holes, The spacer 118 is inserted into said holes and onto said shank of said bolt, The second of the washers 112 is placed onto said shank and secured by the wing nut 114. Said nut is tightened enough to prevent free movement yet allow movement when sufficient pressure is applied to said handle or said rod in a relative motion against each other.

Direction for using FIG. (5*b*)

Figure 5B:
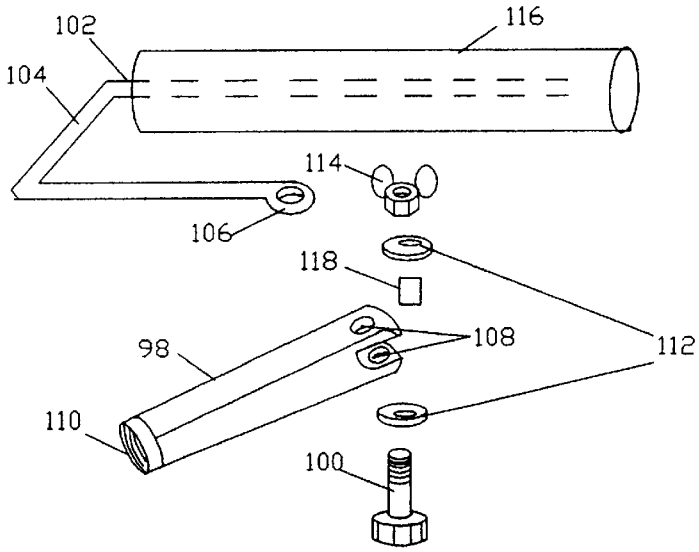
FIG. 5*b* is a continuous frame with a looped pivot point and a yoke type handle.

This embodiment is used like most other paint roller. To change the angle of the yoke handle 98 relative to the axle rod 102, hold the roller cage/cover 116 flat on the surface to be treated. Rotate said handle on the looped pivot point 106. Angle may be also changed by holding in one hand, the open part of the one piece wire frame 104, and in the other hand said handle, and moving said parts in a relative motion against each other. A standard extension pole, (not shown in FIG. 5*b*), may be threaded into the threaded receiver hole 110.

| Detail of FIG. (1–4) | |
|---|---|
| 10 | Roller cage/cover |
| 12 | Axle rod |
| 14 | Roller support rail |
| 16 | Pivot point |
| 18 | Cross-piece |
| 20 | Threaded pivot shaft |
| 22 | Elongated bar |
| 24 | Lock hole |
| 26 | Fulcrum kick |
| 28 | Coil spring |
| 30 | String lever |
| 32 | String |
| 34 | Finger pull string |
| 36 | Threaded gear or nut |
| 38 | Washer |
| 40 | Handle |
| 42 | Washer bushing |
| 44 | Lock nut |
| 46 | Pivot hole |
| 48 | Extension pole hole |
| 50 | Guide band |
| 52 | Pivot hole band |
| 54 | Pivot pin |
| 56 | Extension pole |
| 58 | String support band |
| 70 | Acute angle relative to the plane |
| **Detail of FIG. (5a,5b)** | |
| 60 | Retainer |
| 62 | Hollow frame |
| 64 | Perforated roller cover |
| 66 | receiver end |
| 68 | Paint exit ports |

-continued

| | |
|---|---|
| 70 | Acute angle relative to the plane |
| 72 | Flexible supply tube |
| 74 | Washer |
| 78 | Supply tube connection |
| 80 | Compressor pump |
| 82 | Paint supply |
| 84 | Handle pivot hole |
| 86 | Butterffy nut |
| 88 | Handle |
| 90 | Threaded receiver hole |
| 92 | Hollow threaded pivot point |
| 94 | Nut |
| 96 | Washer bushing |
| 98 | Yoke handle |
| 100 | Bolt |
| 102 | Axle rod |
| 104 | One piece wire frame |
| 106 | Looped pivot point |
| 108 | Handle pivot holes |
| 110 | Threaded receiver hole |
| 112 | Wahsers |
| 114 | Wing nut |
| 116 | Roller cage/cover |
| 118 | Spacer |

I claim:

1. An adjustable paint roller comprising:

(a) an elongated handle having a pivot hole at an end thereof;

(b) a continuous roller frame comprising an elongated axle rod adapted to support a paint roller thereon, a cross piece extending from and substantially perpendicular to an end of said axle rod, a support rail extending from and substantially perpendicular to an end of said cross piece and a threaded pivot shaft extending from and substantially perpendicular to an end of said support rail, said pivot shaft being located in said pivot hole whereby the roller frame is pivotally connected to said handle; the axle rod, cross piece and support rail defining a plane, said pivot shaft further being canted toward said axle rod such that it defines an acute angle with respect to said plane whereby the axis of the axle rod is located in substantially the same plane as the axis of the handle; and (c) means for adjusting the position of the roller frame relative to the handle.

2. The adjustable paint roller of claim 1 said adjusting means includes a locking device pivotally connected to said handle at a point located between opposite first and second ends of the locking device, said first end being located about said pivot shaft and said second end being connected to a string, said string having a thumb ring at an end thereof to enable the user to pivot said locking device into and out of engagement with said roller frame.

3. The adjustable paint roller frame of claim 1 wherein said continuous roller frame is hollow and said pivot shaft is adapted to be connected to a paint supply whereby paint may be supplied to the paint roller mounted on said axle rod.

* * * * *